US008147047B2

(12) United States Patent
Iwamura et al.

(10) Patent No.: US 8,147,047 B2
(45) Date of Patent: Apr. 3, 2012

(54) LIQUID SUPPLY APPARATUSES AND LIQUID CONTAINERS

(75) Inventors: Yuko Iwamura, Nagoya (JP); Hirofumi Kondo, Tajimi (JP); Hitomi Sadohara, Nagoya (JP); Hiroto Sugahara, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 351 days.

(21) Appl. No.: 12/579,738

(22) Filed: Oct. 15, 2009

(65) Prior Publication Data

US 2010/0103231 A1 Apr. 29, 2010

(30) Foreign Application Priority Data

Oct. 29, 2008 (JP) ..... 2008-278196

(51) Int. Cl.
*B41J 2/175* (2006.01)

(52) U.S. Cl. ..... 347/86; 347/85

(58) Field of Classification Search ..... 347/7, 49, 347/85, 86, 87

See application file for complete search history.

(56) References Cited

U.S. PATENT DOCUMENTS

| | | | | |
|---|---|---|---|---|
| 6,502,933 | B2 * | 1/2003 | Lim et al. | 347/86 |
| 6,623,092 | B2 | 9/2003 | Kim et al. | |
| 6,733,114 | B2 * | 5/2004 | Kobayashi et al. | 347/85 |
| 7,416,290 | B2 | 8/2008 | Hattori et al. | |

FOREIGN PATENT DOCUMENTS

| | | | |
|---|---|---|---|
| JP | 2003-063030 | A | 3/2003 |
| JP | 2005-145126 | A | 6/2005 |
| JP | 2008-087159 | A | 4/2008 |
| JP | 2008-238643 | A | 10/2008 |

* cited by examiner

*Primary Examiner* — Anh T. N. Vo
(74) *Attorney, Agent, or Firm* — Baker Botts, L.L.P.

(57) ABSTRACT

A liquid supply apparatus includes a container mounting portion and a liquid container. The liquid container includes a case configured to store liquid therein, a first movable member positioned in the case, a second movable member positioned on the case, and a retainer configured to retain the second movable member in the first position. The first movable member and the second movable member include a pair of magnetic materials. When the second movable member moves from a first position to a second position, the first movable member is released from a fixed state in which the first movable member is immovably fixed to the case by a magnetic force acting between the pair of magnetic materials.

8 Claims, 8 Drawing Sheets

LIQUID SUPPLY APPARATUSES AND LIQUID CONTAINERS

CROSS-REFERENCE TO RELATED APPLICATION

The present application claims priority from Japanese Patent Application No. JP-2008-278196, which was filed on Oct. 29, 2008, the disclosure of which is incorporated herein by reference in its entirety.

BACKGROUND OF THE INVENTION

1. Field of the Invention

The present invention relates to liquid supply apparatuses and liquid containers.

2. Description of Related Art

A known liquid container, e.g., a liquid cartridge is configured to be removably mounted to a container mounting portion provided in an apparatus such as an ink-jet printer. The known liquid container has a movable member, such as a float, which is configured to move according to the change of the liquid level in the container. By detecting the position of the movable member, the liquid amount (liquid level) in the container can be determined.

For example, a known ink cartridge such as an ink cartridge described in JP-A-2008-087159 is configured to be removably mounted to a cartridge mounting portion of an ink jet printer. The ink cartridge has an arm having a float and a light-blocking panel at both ends thereof. The amount of ink stored in the ink cartridge can be determined by detecting the position of the light-blocking panel when the float moves up and down according to the change of the ink level in the cartridge. Such a detection is performed by an optical sensor provided at the cartridge mounting portion.

In the liquid container having the movable member such as the float as described above, when the movable member moves greatly due to the fluctuation of the liquid surface caused by vibrations applied from the outside of the container when the container is not in use, e.g., when the container is transported, the movable member or the interior of the container may be damaged. Moreover, when bubbles are formed in the liquid container by the movement of the movable member, and the liquid container is used with the bubbles formed therein, the movement of the movable member may be blocked by the bubbles, and the liquid amount in the container cannot be determined accurately. Therefore, in another known liquid container, the movable member is fixed to a case of the container when the liquid container is not used.

For example, a fuel tank such as a fuel tank described in JP-A-2005-145126, stores fuel for an automotive vehicle and has a float configured to be detected for determining the amount of fuel in the tank. This fuel tank has a stopper configured to restrict the movement of the float, and a string connected to the stopper. The movement of the float is restricted by the stopper when the fuel tank is transported, and the float is released from the restriction when the stopper is removed by pulling the string.

The stopper is configured to restrict the movement of the float by directly contacting the float, and the string is connected to the stopper such that the stopper can be removed from the outside of the tank when the tank is used. However, when the string is pulled from the outside of the tank, the float may be damaged because a force to pull the string may be applied heavily to the float, or the stopper may come into contact with and hence damage the interior of the tank before being removed out of the tank. Therefore, an attention should be paid not to cause the damage when the stopper is removed.

SUMMARY OF THE INVENTION

Therefore, a need has arisen for liquid supply apparatuses and liquid containers which at least reduce these and other shortcomings of the related art. A technical advantage of the present invention is that a movable member, which is configured to move according to an amount of liquid stored in a case, can be fixed indirectly to the case using a magnetic force, and the first movable member readily can be released from a fixed state.

According to an embodiment of the present invention, a liquid supply apparatus comprises a container mounting portion and a liquid container configured to be removably mounted to the container mounting portion. The liquid container comprises a case configured to store liquid therein, a first movable member positioned in the case and configured to move relative to the case according to an amount of liquid stored in the case, a second movable member positioned on the case and configured to move relative to the case between a first position and a second position, and a retainer configured to retain the second movable member in the first position. The first movable member and the second movable member comprise a pair of magnetic materials on which a magnetic force acts such that the pair of magnetic materials attracts each other. When the second movable member is in the first position, the first movable member is in a fixed state in which the first movable member is immovably fixed to the case by the magnetic force acting between the pair of magnetic materials. When the second movable member moves from the first position to the second position, the first movable member is released from the fixed state. The container mounting portion comprises a release member configured to release the second movable member from a retained state in which the second movable member is retained in the first position by the retainer, such that the second movable member moves from the first position to the second position, when the liquid container is mounted to the container mounting portion.

According to another embodiment of the present invention, a liquid container comprises a case configured to store liquid, a first movable member positioned in the case and configured to move relative to the case according to an amount of liquid stored in the case, a second movable member positioned on the case and configured to move relative to the case between a first position and a second position, and a retainer configured to retain the second movable member in the first position. The first movable member and the second movable member comprise a pair of magnetic materials on which a magnetic force acts such that the pair of magnetic materials attracts each other. The second movable member is in the first position, the first movable member is in a fixed state in which the first movable member is immovably fixed to the case by the magnetic force acting between the pair of magnetic materials. The second movable member is released from a retained state in which the second movable member is retained in the first position by the retainer, such that the second movable member moves from the first position to the second position, the first movable member is released from the fixed state.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-8, like numerals being used for like corresponding portions in the various drawings.

Figure 1:
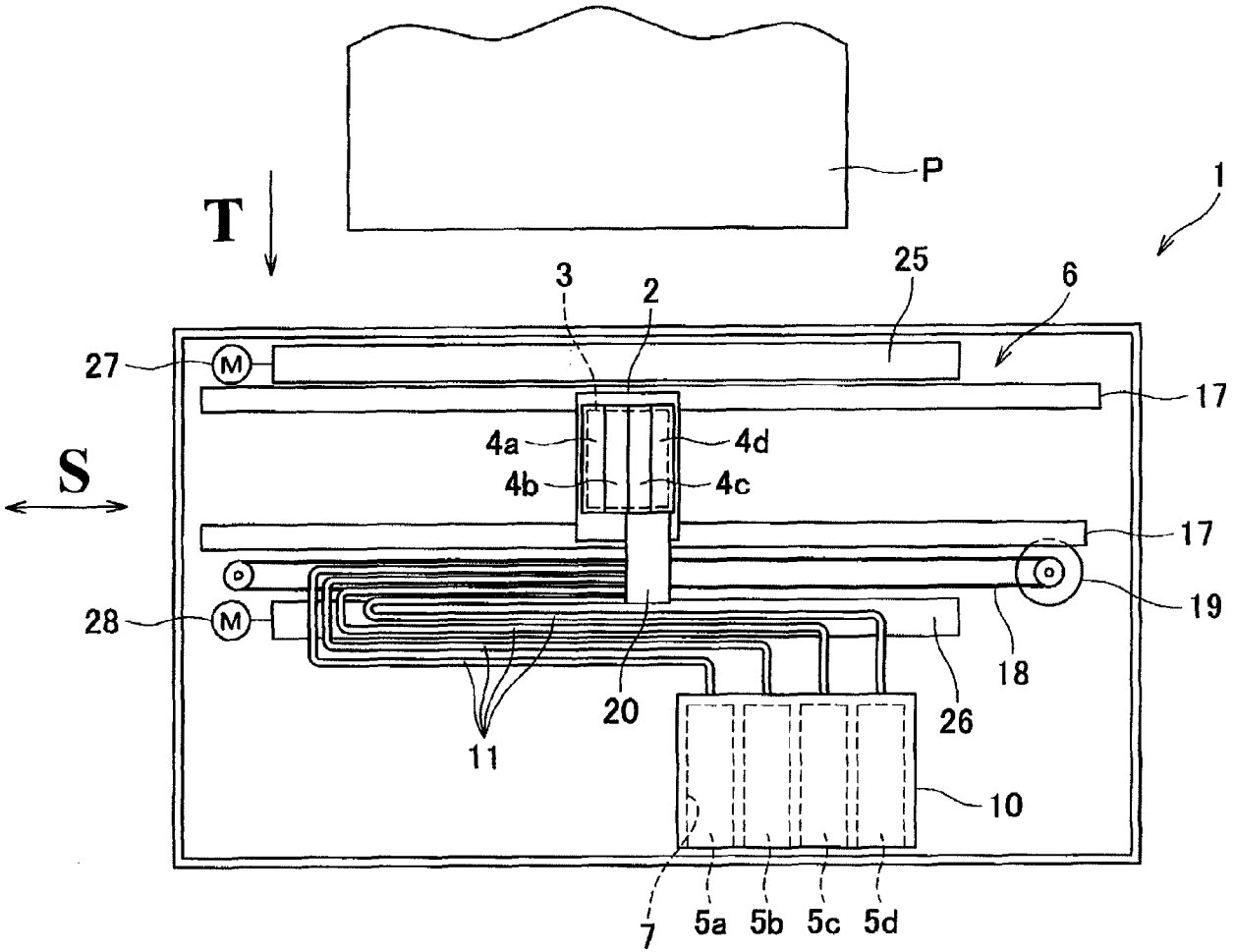
FIG. 1 is a schematic view of an ink jet printer according to an embodiment of the present invention.

Referring to FIG. 1, an ink-jet printer 1 may comprise a carriage 2 configured to be reciprocate along a scanning direction S, an ink jet head 3 and four sub tanks 4*a* to 4*d* mounted on the carriage 2, four ink cartridges 5*a* to 5*d* as an example of liquid containers, a holder 10 comprising four cartridge mounting portions 7 as an example of container mounting portions, to which the four ink cartridges 5*a* to 5*d* are mounted, respectively, and a transporting device 6 configured to transport a sheet of paper P in a paper transporting direction T. Four ink cartridges 5*a* to 5*d* and four cartridge mounting portions 7 may be an example of liquid supply apparatuses.

The carriage 2 may be configured to reciprocate along two guide shafts 17 extending in the scanning direction S. An endless belt 18 may be connected to the carriage 2, and the carriage 2 may be configured to move in the scanning direction S in association with the travel of the endless belt 18 when the endless belt 18 is driven to travel by a carriage drive motor 19.

The ink jet head 3 and the four sub tanks 4*a* to 4*d* may be mounted on the carriage 2. The ink-jet head 3 may comprise nozzles in its lower surface. The four sub tanks 4*a* to 4*d* may be aligned in the scanning direction S, and a tube joint 20 is integrally provided on the four sub tanks 4*a* to 4*d*. The four sub tanks 4*a* to 4*d* and the four ink cartridges 5*a* to 5*d* may be in fluid communication via flexible tubes 11 connected to the tube joint 20.

The holder 10 may comprise four cartridge mounting portions 7 aligned in the scanning direction S, and the four ink cartridges 5*a* to 5*d* may be configured to removably mounted to the four cartridge mounting portions 7, respectively. The four ink cartridges 5*a* to 5*d* may contain inks in four colors of black, yellow, cyan, and magenta, respectively.

The inks in four colors stored in the four ink cartridges 5*a* to 5*d* may be supplied to the four sub tanks 4*a* to 4*d*, respectively, via the four tubes 11 connected to the holder 10, and may be stored temporarily in the sub tanks 4*a* to 4*d*, and then may be supplied to the ink-jet head 3. The ink jet head 3 may reciprocate in the scanning direction S together with the carriage 2 and eject ink droplets onto the sheet of paper P transported by the transporting device 6 from the nozzles provided in the lower surface thereof.

The transporting device 6 may comprise a paper feeding roller 25 positioned on the upstream side of the ink-jet head 3 with respect to the paper transporting direction T, and a paper discharging roller 26 positioned on the downstream side of the ink jet head 3 with respect to the paper transporting direction T. The paper feeding roller 25 and the paper discharging roller 26 may be driven to rotate by a paper feeding motor 27 and a paper discharging motor 28, respectively. The transporting device 6 may be configured to feed the sheet of paper P to underneath the ink-jet head 3 from the upstream side by the paper feeding roller 25, and discharge the sheet of paper P, on which an image or characters are printed by the ink jet head 3, to the downstream side by the paper discharging roller 26.

Figure 2:
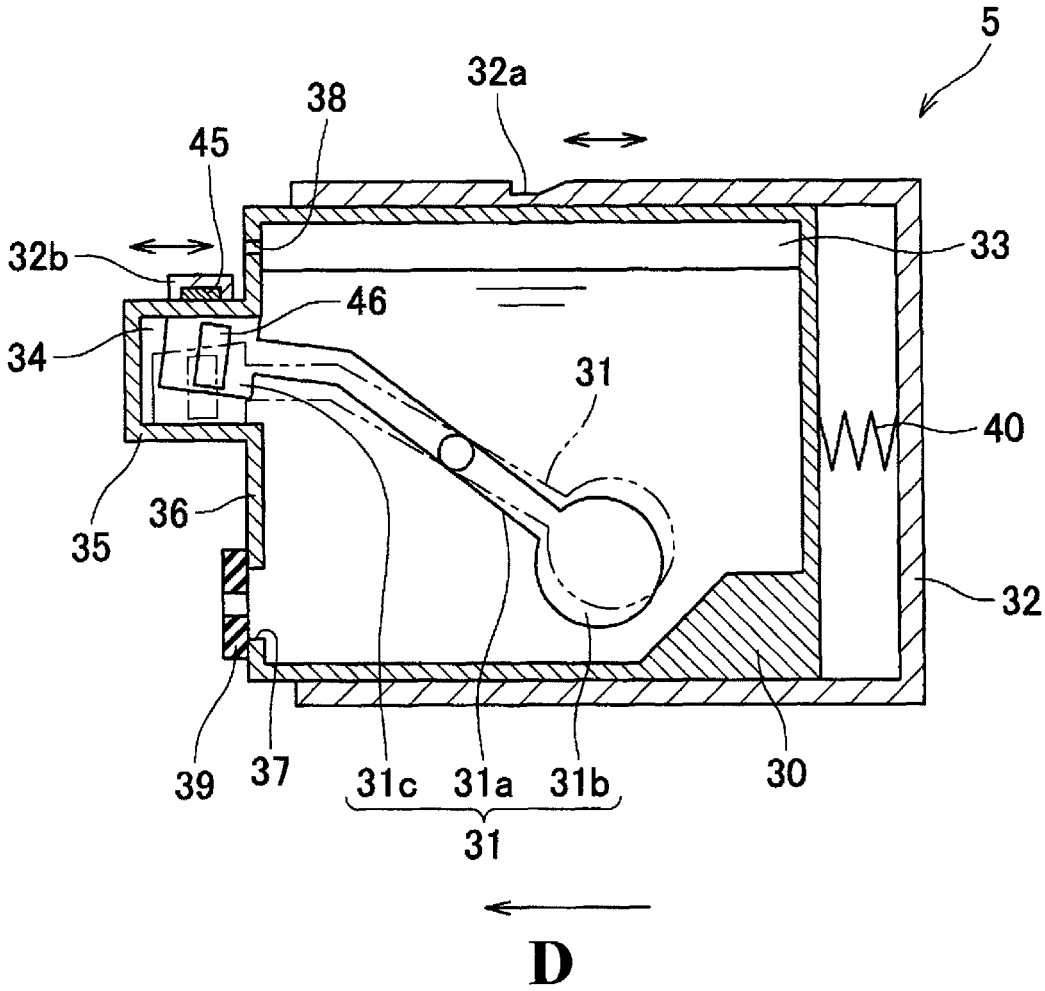
FIG. 2 is a cross-sectional view of an ink cartridge according to an embodiment of the present invention.

Because the four ink cartridges 5*a* to 5*d* storing the inks in four colors respectively have the same configuration, one of them will be described in the following with a reference numeral 5. FIG. 2 is a cross-sectional view of the ink cartridge 5 taken along a plane including a mounting direction D along which the ink cartridge 5 is mounted to the cartridge mounting portion 7. In the following, "front" means "front" with respect to the mounting direction D, and "rear" or "back" means "rear" or "back" with respect to the mounting direction D.

Referring to FIG. 2, the ink cartridge 5 may comprise a case 30 configured to store ink therein, and the case 30 may have an ink supply opening 37 formed through a front wall 36 of the case 30, a pivotable member 31 positioned in the case 30, such that it can be determined whether or not a predetermined amount or more of ink is stored in the case 30, and a cover 32, as an example of the second movable member, configured to slide on the outer surface of the case 30 in the mounting direction D and a direction opposite to the mounting direction D.

The case 30 may comprise a translucent material, e.g., a transparent or semi-transparent material, such as synthetic resin or the like, such that light, e.g., visible or infrared light can pass therethrough. The case 30 may have a substantially rectangular parallelepiped shape. The case 30 may comprise an ink chamber 33 formed therein, and the ink chamber 33 is configured to store ink therein. The case 30 may comprise a projecting portion 35 projecting forwardly from the front wall 36. The projecting portion 35 may have a sensor chamber 34 formed therein, and the sensor chamber 34 may be in fluid communication with the ink chamber 33. A light blocking panel 31*c* of the pivotable member 31, descried below, may be positioned in the sensor chamber 34 of the projecting portion 35.

The ink supply opening 37 may be formed through a lower portion of the front wall 36 of the case 30, and the ink supply opening 37 may be in fluid communicating with a lower portion of the ink chamber 33, such that ink is supplied from the ink chamber 33 to the outside of the case 30 via the ink supply opening 37. An annular sealing member 39 formed of rubber or the like may be attached to a portion of the front wall 36 surrounding the ink supply opening 37. Furthermore, an air communication opening 38 may be formed through an upper portion of the front wall 36, and the air communication opening 38 may be in fluid communication with an upper portion of the ink chamber 33, such that air is introduced into the ink chamber 33 from the outside of the case 30 via the air communication opening 38.

The pivotable member 31 may comprise an arm 31*a* pivotably supported by the case 30 in the ink chamber 33, a float 31*b* connected to one end of the arm 31*a*, and the light blocking panel 31*c*, as an example of the first movable member, connected to the other end of the arm 31*a*. The float 31*b* may be configured to move up and down according to the change of the ink level in the case. The light blocking panel 31*c* may be stored in the sensor chamber 34 of the projecting portion 35, and may be configured to be able to block light emitted from an optical sensor 53 (see FIG. 3) provided at the cartridge mounting portion 7 when the ink cartridge 5 is mounted to the cartridge mounting portion 7 of the holder 10. For example, the light blocking panel 31*c* may be configured to prevent at least a portion of the light from passing therethough or may be configured to alter the path of at least a portion of the light.

The pivotable member 31 may be configured to pivot such that the light blocking panel 31*c* connected to the float 31*b* via the arm 31*a* moves up and down relative to the case 30 in the sensor chamber 34 when the float 31*b* moves up and down according to the change of the ink level in the ink chamber 33. More specifically, when a sufficient amount of ink is stored in the ink chamber 33, large buoyancy acts on the float 31*b*, and a moment in the counterclockwise direction in FIG. 2 is applied to the arm 31*a*, such that the light blocking panel 31*c* comes into contact with the bottom surface of the sensor chamber 34 as shown by a double dashed chain line in FIG. 2. In contrast, when the amount of ink in the ink chamber 33 is reduced and the float 31*b* is partly exposed from the ink surface, the buoyancy acting on the float 31*b* is reduced, such that the buoyancy and the gravity acting on the float 31*b* balance out. When the amount of ink in the ink chamber 33 is further reduced, the float 31*b* moves down following the lowering ink level, such that the arm 31*a* pivots clockwise in FIG. 2, and the light blocking panel 31*c* comes into contact with the top surface of the sensor chamber 34 as shown by a solid line in FIG. 2.

The cover 32 may have a substantially rectangular parallelepiped shape having an opening on its front side. The inner space formed in the cover 32 may be slightly larger than the case 30. The case 30 may be stored in the cover 32 by inserting the case 30 into the cover 32 via the opening of the cover 32, such that the case 30 is protected by the cover 32. The cover 32 may be configured to move relative to the case 30 in the mounting direction D and a direction opposite to the mounting direction D. A spring 40, as an example of the retainer, may be interposed between a bottom surface of the cover 32, i.e., the inner surface of a rear wall of the cover 32, and the outer surface of a rear wall of the case 30. When the ink cartridge 5 is dropped and contacts a surface, the spring 40 may absorb the impact of the contact, and the case 30 may not be damaged. The cover 32 may be retained in a first position relative to the case 30 by the urging force of the spring 40, such that a front portion of the case 30 where the ink supply opening 37 is formed projects from the cover 32. An engaging depressed portion 32*a* may be formed in an upper outer surface of the cover 32. A locking member 55 provided at the cartridge mounting portion 7 (see FIG. 3) may engage the engaging depressed portion 32*a* when the ink cartridge 5 is mounted to the cartridge mounting portion 7.

The ink cartridge 5 may comprise a mechanism for immovably fixing the pivotable member 31, which is configured to pivot in the ink chamber 33, to the case 30 when the ink cartridge 5 is not mounted to the cartridge mounting portion 7 of the holder 10.

More specifically, the light blocking panel 31*c* of the pivotable member 31 may comprise a metal piece 46, made of a soft magnetic material. Among magnetic materials, the soft magnetic material is a material in which magnetic poles vanish or are inverted relatively easily. In other words, the soft magnetic material is magnetized relatively easily by a magnetic field of a permanent magnet to generate a magnetic force which causes the soft magnetic material and the permanent magnet to attract each other, and the magnetic poles in the soft magnetic member vanish when the magnetic field of the permanent magnet does not reach the soft magnetic material so as not to generate a magnetic field by itself. The cover 32 may comprise a supporting portion 32*b* which contacts the upper outer surface of the projecting portion 35, and the supporting portion 32*b* may support a permanent magnet 45. The permanent magnet supported by the supporting portion 32*b* may be movable integrally with the cover 32 in the mounting direction D relative to the case 30. When the cover 32 is retained in the first position shown in FIG. 2 by the urging force of the spring 40, the supporting portion 32*b* may be positioned substantially directly above the light blocking panel 31*c*, and a magnetic force acts on the permanent magnet 45 supported by the supporting portion 32*b* and the metal piece 46 of the light blocking panel 31*c*, such that the permanent magnet 45 and the metal piece 46 attract each other. The light blocking panel 31*c* may be immovably fixed to the case 30 by the magnetic force acting between the permanent magnet 45 and the metal piece 46 in an upper end position of the movable range of the light blocking panel 31*c*, i.e., in a position where the light blocking panel 31*c* contacts the top surface of the sensor chamber 34.

Referring to FIG. 1, the holder 10 may comprise the four cartridge mounting portions 7 aligned in the scanning direction S. Because the four cartridge mounting portions 7 have the same configuration, one of them will be described in the following.

Figure 3:
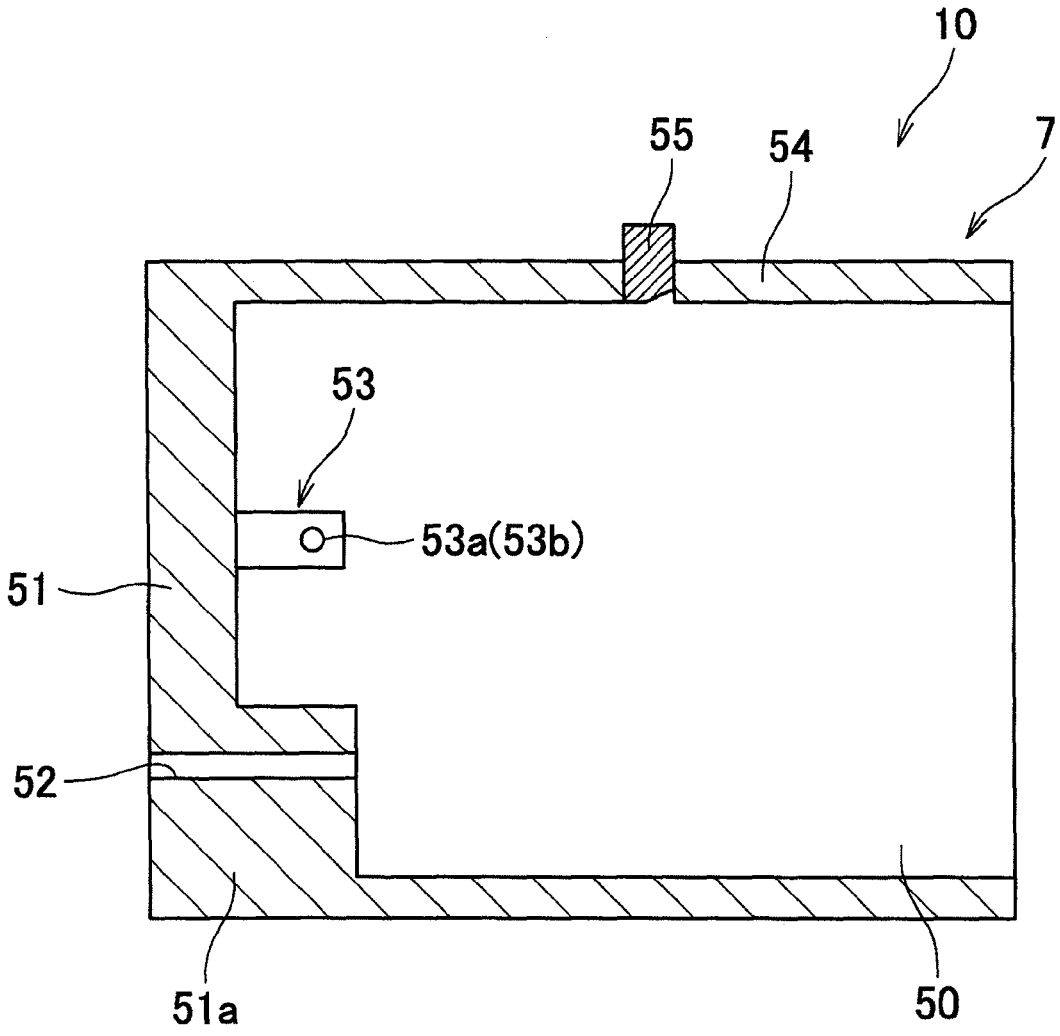
FIG. 3 is a cross-sectional view of a holder according to an embodiment of the present invention.

Referring to FIG. 3, the cartridge mounting portion 7 may comprise a cartridge storage chamber 50 which is opened backward, a front wall 51 positioned opposite to the opening of the cartridge storage chamber 50 with respect to the mounting direction D, an ink supply channel 52 formed through the front wall 51, and the optical sensor 53 provided on the front wall 51.

The ink cartridge 5 may be inserted into the cartridge storage chamber 50 via the opening of the cartridge storage chamber 50. A lower portion of the front wall 51 may comprise a protruding portion 51*a* which protrudes backward relative to an upper portion of the front wall 51. The ink supply channel 52 may be formed through the protruding portion 51*a*. The ink supply channel 52 may be in fluid communication with the ink-jet head 3 via the tube 11 shown in FIG. 1. The optical sensor 53 may be provided at a center portion of the front wall 51 with respect to the gravitational direction, and may comprise a light-emitting portion 53*a* and a light-receiving portion 53*b* aligned in a horizontal direction which is perpendicular to the mounting direction D. The light-emitting portion 53*a* and the light-receiving portion 53*b* may face each other separated at a predetermined distance. The locking member 55 may be provided in an upper wall of the cartridge mounting portion 7, such that the locking member 55 may move up and down. The locking member 55 may be configured to engage the engaging depressed portion 32*a* of the ink cartridge 5 mounted in the cartridge storage chamber 50.

Figure 4A:
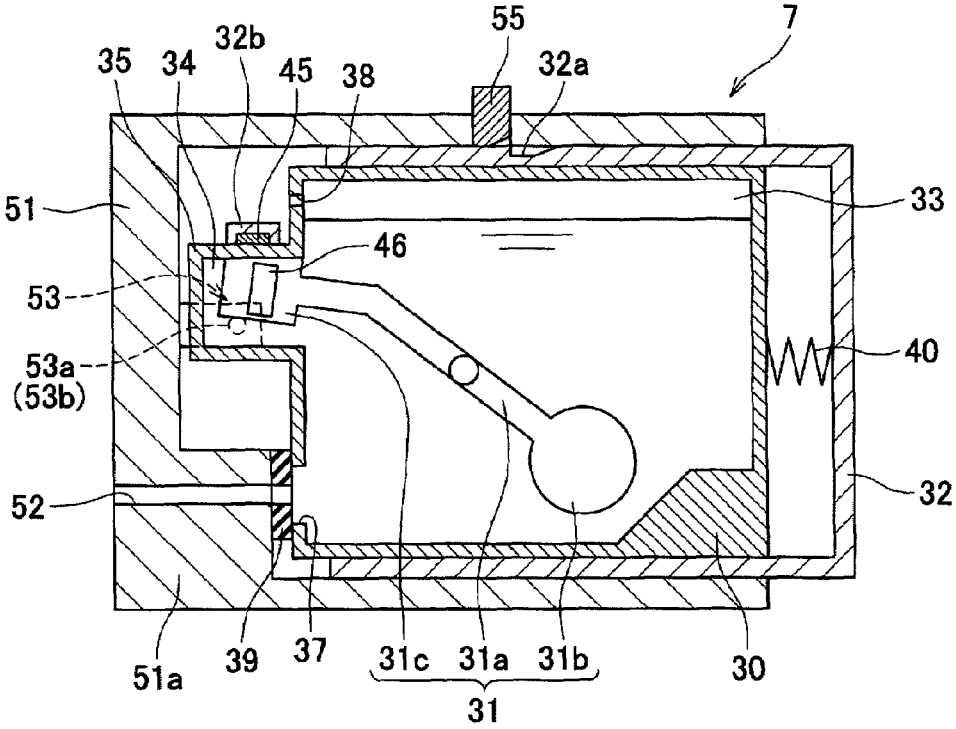
FIGS. 4(A) and 4(B) are cross-sectional views of the ink cartridge and the holder, showing a process of mounting the ink cartridge to a cartridge mounting portion of the holder, in which the ink cartridge is being mounted to the cartridge mounting portion in FIG. 4(A) and the mounting is completed in FIG. 4(B).
Figure 4B:
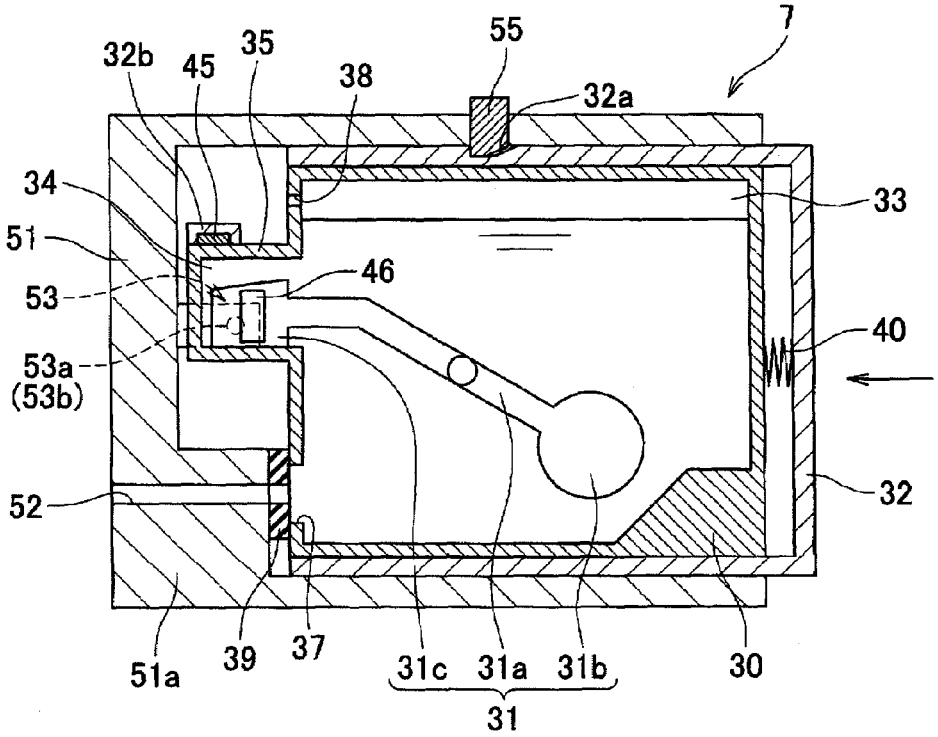

Referring to FIG. 4(*a*), when the ink cartridge 5 is mounted to the cartridge mounting portion 7, the ink cartridge 5 may be inserted into the cartridge storage chamber 50 of the cartridge mounting portion 7 while the cover 32 is pushed forward by a user. At this time, the case 30 and the cover 32 may be integrally moved forward while maintaining a predetermined positional relationship therebetween by the spring 40, i.e., the case 30 and the cover 32 may move together while the cover 32 is in the first position.

Subsequently, the front portion of the case 30 projecting forward from the cover 32 may come into contact with the protruding portion 51*a* of the cartridge mounting portion 7 via the sealing member 39. When the cover 32 is further pushed forward, because the forward movement of the cover 32 is not restricted, the cover 32 may move forward relative to the case 30 against the urging force of the spring 40 as shown in FIG. 4(*b*). In other words, because a reactive force acts on the case 30 from the protruding portion 51*a*, the case 30 may not move forward and only cover 32 may move forward, such that the cover 32 moves relative to the case 30 in the mounting direction D. Consequently, the cover 32 may move from the first position shown in FIG. 4(*a*) to a second position shown in FIG. 4(*b*) relative to the case 30. Because the supporting portion 32*b* of the cover 32 slides forward on the projecting portion 35 of the case 30, the permanent magnet 45 supported by the supporting portion 32*b* may move forward from the position directly above the light blocking panel 31*c*. Accordingly, the magnetic force acting between the metal piece 46 of the light blocking panel 31*c* and the permanent magnet 45 of the supporting portion 32*b* may become weakened, and the light blocking panel 31*c* may be released from a fixed state in which the light blocking panel 31*c* is immovably fixed to the case 30 by the magnetic force. In this manner, light blocking panel 31*c* may be readily released from the fixed state in conjunction with the mounting operation of the ink cartridge 5 to the cartridge mounting portion 7.

The protruding portion 51*a* may come into contact only with the case 30 and exert a reactive force on the case 30, which may release the cover 32 from a retained state in which the cover 32 is retained in the first position by the spring 40, such that the cover 32 moves relative to the case 30. As such, the protruding portion 51*a* may function as the release member. In this manner, in this embodiment, the cover 32 can be released from the retained state with a simple structure such as the protruding portion 51*a* which comes into contact with the case 30 when the ink cartridge 5 is mounted to the cartridge mounting portion 7.

When the cover 32 moves to the second position shown in FIG. 4(*b*), the locking member 55 provided at the cartridge mounting portion 7 may engage the engaging depressed portion 32*a* formed in the cover 32. With this engagement, the movement of the cover 32 in the mounting direction D and the direction opposite to the mounting direction D may be restricted and the ink cartridge 5 may be prevented from being removed form the cartridge mounting portion 7. When this occurs, the ink supply channel 52 formed through the protruding portion 51*a* and the ink supply opening 37 formed in the case 30 may become in fluid communication with each other. The air communication opening 38 formed in the case 30 may have been opened, and consequently, air may be introduced from the outside of the case 30 via air communication opening 38 into the ink chamber 33 while the ink in the ink chamber 33 is supplied via the ink supply opening 37 into the ink supply channel 52 of the cartridge mounting portion 7.

Moreover, the projecting portion 35 of the case 30 may be inserted between the light-emitting portion 53*a* and the light-receiving portion 53*b* of the optical sensor 53. Before the ink cartridge 5 is mounted to the cartridge mounting portion 7, the light blocking panel 31*c* may be fixed to the case 30 in the upper end position where the light blocking panel 31*c* contacts the top surface of the sensor chamber 34, i.e., in the upper end position of the movable range of the light blocking panel 31*c* when the amount of ink in the ink chamber 33 is small. Therefore, if a sufficient amount of ink is stored in the ink chamber 33 when the light blocking panel 31*c* is released from the fixed state, the light blocking panel 31*c* may move from the upper end position to a lower end position of the movable range where the light blocking panel 31*c* contacts the bottom surface of the sensor chamber 34 in association with the upward movement of the float 31*b* by buoyancy as shown in FIG. 4(*b*). In this case, the light emitted from the light-emitting portion 53*a* may be blocked by the light blocking panel 31*c*, and may not be received by the light-receiving portion 53*b*.

In contrast, if the amount of ink in the ink chamber 33 is small, the buoyancy acting on the float 31*b* may be small, and therefore the float 31*b* may not move upward, and the light blocking panel 31*c* may remain in the upper end position where the light blocking panel 31*c* contacts the top surface of the sensor chamber 34 and may not move downward. In this case, the light emitted from the light-emitting portion 53*a* may not be blocked by the light blocking panel 31*c*, and may be received by the light-receiving portion 53*b*. The optical sensor 53 may correspond to the movement detector configured to detect whether or not the light blocking panel 31*c* move downward from the upper end position when the light blocking panel 31*c* is released from the fixed state.

When the ink cartridge 5 is removed from the cartridge mounting portion 7, the locking member 55 may be pulled up, such that the locking member 55 moves away from the engaging depressed portion 32*a*. When this occurs, the cover 32 may move backward to the first position by the urging force of the spring 40. In this manner, with the cover 32 and the spring 40, the user readily can remove the ink cartridge 5 from the cartridge mounting portion 7. When the ink cartridge 5 having little ink remaining therein is removed from the cartridge mounting portion 7, the light blocking panel 31*c* may be positioned in the upper end position. Therefore, when the cover 32 is returned to the first position by the urging force of the spring 40, the light blocking panel 31*c* may be fixed to the case 30 without changing its position. Therefore, the light blocking panel 31*c* or the case 30 may not becomes damaged or may not generate noise when the used ink cartridge 5 is transported.

As described above, the pair of magnetic materials (the metal piece 46 and the permanent magnet 45) are provided to the light blocking panel 31*c* of the pivotable member 31 and the cover 32 in order to fix the pivotable member 31 to the case 30. If the permanent magnet 45 which generates a magnetic field therearound by itself were provided to the light blocking panel 31*c* instead of the metal piece 46, in a case where a magnetic material such as a metal component of the cartridge mounting portion 7 is arranged around the ink cartridge 5 when the ink cartridge 5 is mounted to the cartridge mounting portion 7, the movement of the pivotable member 31 might be affected by the magnetic force acting between the permanent magnet 45 and the magnetic material. However, in this embodiment, because the metal piece 46 which does not generate the magnetic field by itself is provided to the light blocking panel 31*c*, even when the metal component or the like is arranged around the ink cartridge 5, the metal piece 46 may not generate a magnetic force with the metal component.

Figure 5:
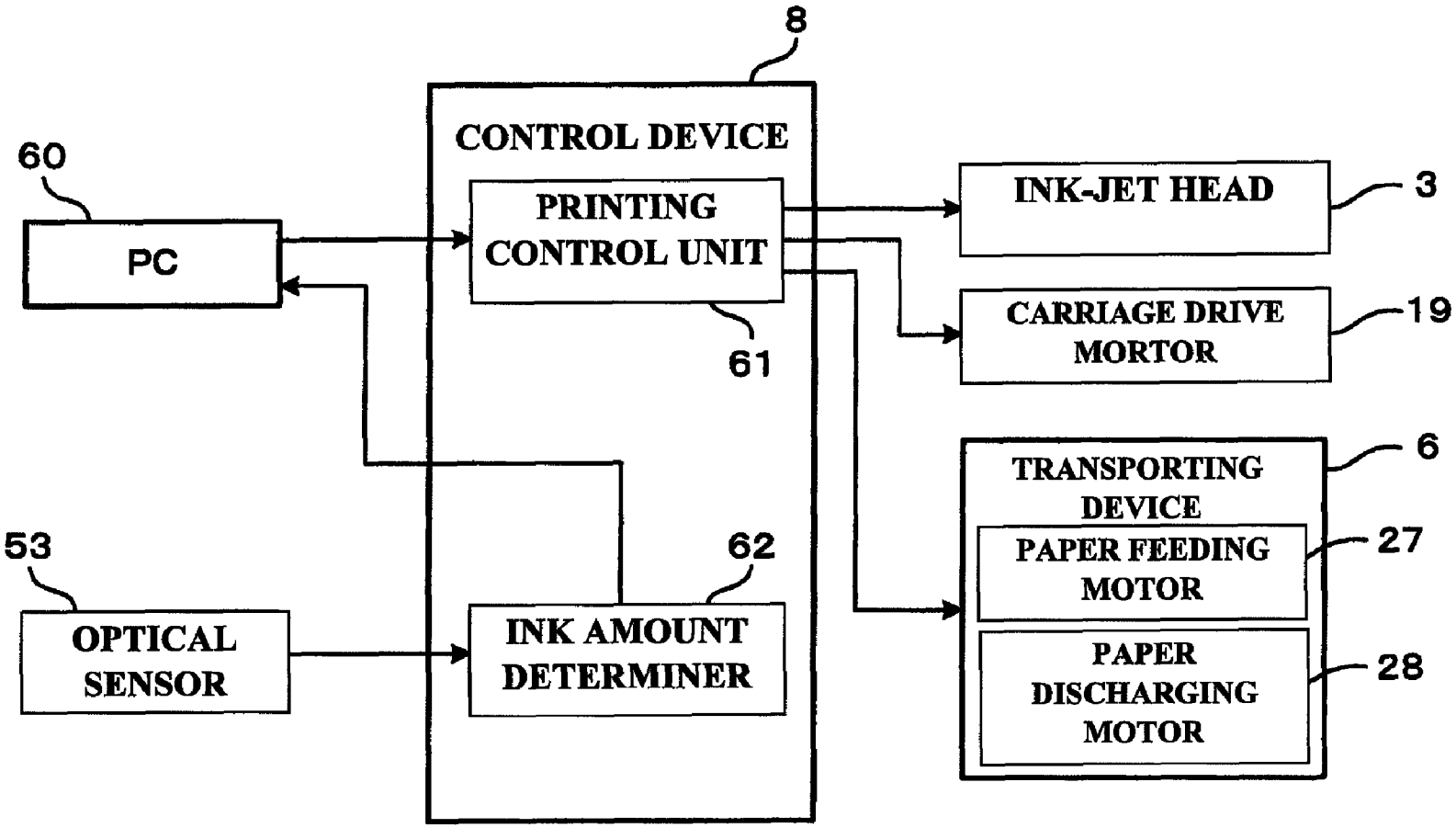
FIG. 5 is a block diagram of an electric configuration of the ink jet printer.

Referring to FIG. 5, a control device 8 of the printer 1 may comprise a CPU (Central Processing Unit), a ROM (Read Only Memory) in which various programs or data for controlling the general movement of the printer 1 is stored, and a RAM (Random Access Memory) for storing the data or the like processed in the CPU temporarily. The control device 8 may be configured to perform various procedures such as a procedure as described below by the programs stored in the ROM being executed by the CPU. In another embodiment, the control device 8 may be realized by a hardware comprising various circuits including calculating circuits.

A printing control unit 61 of the control device 8 may be configured to control the ink-jet head 3, the carriage drive motor 19 configured to drive the carriage 2, the paper feeding motor 27, and the paper discharging motor 28 of the transporting device 6 and to print a desired image or the like on the sheet of paper P on the basis of data relating to the printing image input from a PC 60.

The control device 8 may comprise an ink amount determiner 62 configured to determine whether or not a predetermined amount or more of ink is stored in the ink cartridge 5 on the basis of the output signal of the optical sensor 53 provided at the cartridge mounting portion 7.

As described above, when the ink cartridge 5 is mounted to the cartridge mounting portion 7, the optical sensor 53 may detect whether or not the light blocking panel 31*c* may move downward from the upper end position. Then, the ink amount determiner 62 may determine whether or not the predetermined amount or more of ink is stored in ink cartridge 5 on the basis of the result of detection of the optical sensor 53. More specifically, when the optical sensor 53 detects that the light blocking panel 31*c* moves downward from the upper end position, the ink amount determiner 62 may determine that the predetermined amount or more of ink is stored in the ink cartridge 5, and may notify the PC 60 that the ink cartridge 5 having a sufficient amount of ink is mounted to the cartridge mounting portion 7.

When the ink cartridge 5 having a small amount of ink therein is mounted to the cartridge mounting portion 7, the light blocking panel 31*c* may remain in the upper end position even after the light blocking panel 31*c* is released from the fixed state. Therefore, only with the optical sensor 53, the fact that the ink cartridge 5 is not mounted to the cartridge mounting portion 7 and the fact that ink cartridge 5 having an amount of ink less than the predetermined amount is mounted to the cartridge mounting portion 7 may not be distinguished. However, it may be sufficient if the ink amount determiner 62 can determine that the ink cartridge 5 having the predetermined amount or more of ink therein, which is enough to continue printing, is mounted to the cartridge mounting portion 7, and the fact that the ink cartridge 5 is not mounted to the cartridge mounting portion 7 and the fact that ink cartridge 5 having an amount of ink less than the predetermined amount is mounted to the cartridge mounting portion 7 may not need to be distinguished If necessary, a sensor for detecting whether or not the ink cartridge 5 is mounted to the cartridge mounting portion 7 may be provided.

In the printer 1 in this embodiment described above, because the pivotable member 31 is fixed to the case 30 by the magnetic force acting between the pair of magnetic materials (the metal piece 46 and the permanent magnet 45) provided respectively to the light blocking panel 31*c* of the pivotable member 31 and the cover 32 when the ink cartridge 5 is not mounted to the cartridge mounting portion 7, the pivotable member 31 may prevented from pivoting and the light blocking panel 31*c* may be prevented from moving up and down even if the liquid surface in the ink cartridge 5 fluctuates. Therefore, the damage of the pivotable member 31 and the case 30 or generation of noise can be prevented.

If the pivotable member 31 pivots before the ink cartridge 5 is mounted to the cartridge mounting portion 7, bubbles may be formed in the ink, and if the ink cartridge 5 is mounted to the cartridge mounting portion 7 with such bubbles formed therein, the movement of the pivotable member 31 may be impaired by the bubbles. However, in this embodiment, formation of the bubbles can be prevented by fixing the pivotable member 31 so as not to pivot.

Moreover, when the position of the permanent magnet 45 changes with the movement of the cover 32 to the second position during the mounting of the ink cartridge 5 to the cartridge mounting portion 7, the magnetic force acting on the metal piece 46 of the light blocking panel 31*c* may become weakened and the light blocking panel 31*c* may be released from the fixed state. Therefore, damage caused by an external force applied to the light blocking panel 31*c* when the light blocking panel 31*c* is released may be avoided. In addition, the light blocking panel 31*c* can be released from the fixed state only by mounting the ink cartridge 5 to the cartridge mounting portion 7, and therefore any specific operation for releasing the light blocking panel 31*c* before mounting the ink cartridge 5 to the cartridge mounting portion 7 may not be necessary.

Magnetic materials provided respectively to a light blocking panel and a cover may not be limited to those used in the embodiment described above as long as they generate a magnetic force for attracting each other. For example, in another embodiment, a permanent magnet may be provided to a light blocking panel and a metal piece may be provided to a cover. Alternatively, permanent magnets may be provided to both a light blocking panel and a cover. Also, the magnetic material may not have to be a metal piece, and may be ceramics or the like as long as they generate a magnetic force for attracting each other.

Figure 6:
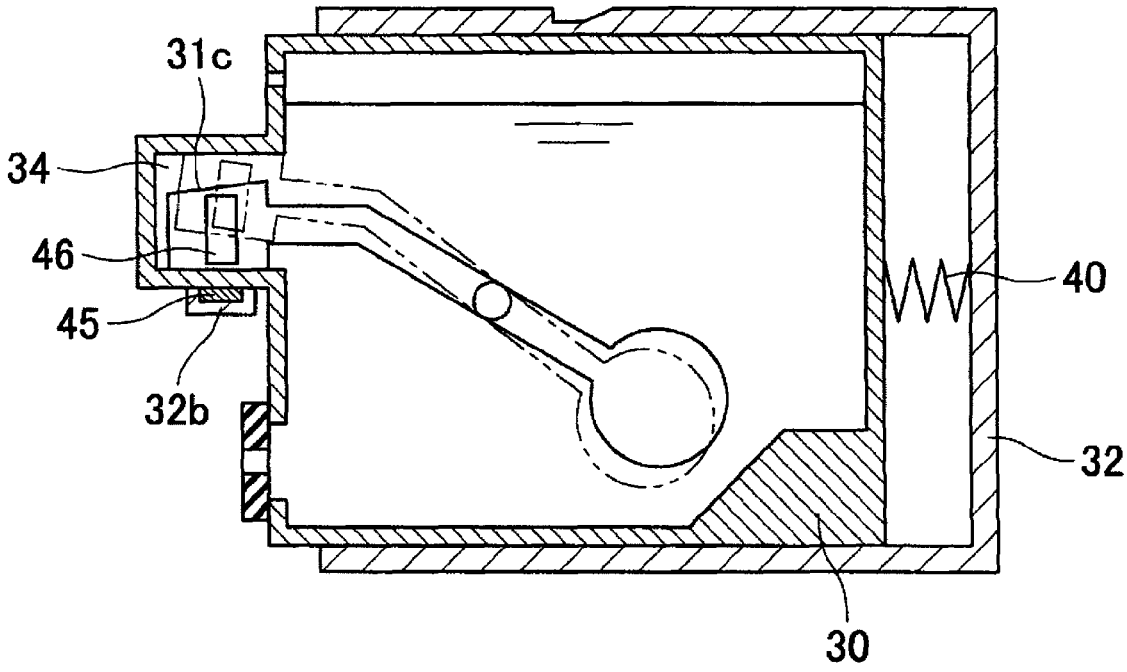
FIG. 6 is a cross-sectional view of the ink cartridge according to another embodiment of the present invention.

Referring to FIG. 6, in another embodiment, the supporting portion 32*b* of the cover 32 supporting the permanent magnet 45 may contact the lower outer surface of the projecting portion 35. When the ink cartridge 5 is not mounted to the cartridge mounting portion 7, the light blocking panel 31*c* may be fixed to the case 30 in the lower end position where the light blocking panel 31*c* contacts the bottom surface of the sensor chamber 34.

In the above described embodiment, the case 30 and the cover 32 comprising the permanent magnet 45 move relative to each other when the case 30 contacts the protruding portion 51*a* provided in the cartridge mounting portion 7 when the ink cartridge 5 is mounted to the cartridge mounting portion 7. However, in another embodiment, a case and a cover comprising a permanent magnet may move relative to each other when the cover contacts a portion of the cartridge mounting portion 7.

Figure 7A:
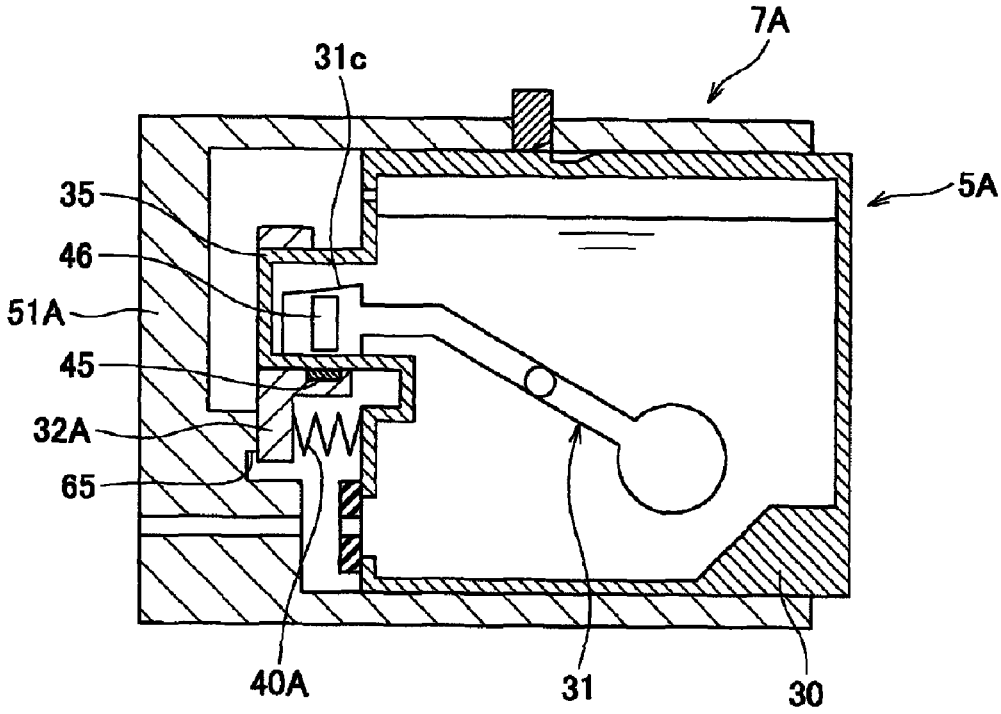
FIGS. 7(A) and 7(B) are cross-sectional views of an ink cartridge and a holder, showing a process of mounting the ink cartridge to a cartridge mounting portion of the holder according to yet another embodiment of the present invention, in which the ink cartridge is being mounted to the cartridge mounting portion in FIG. 7(A) and the mounting is completed in FIG. 7(B).
Figure 7B:
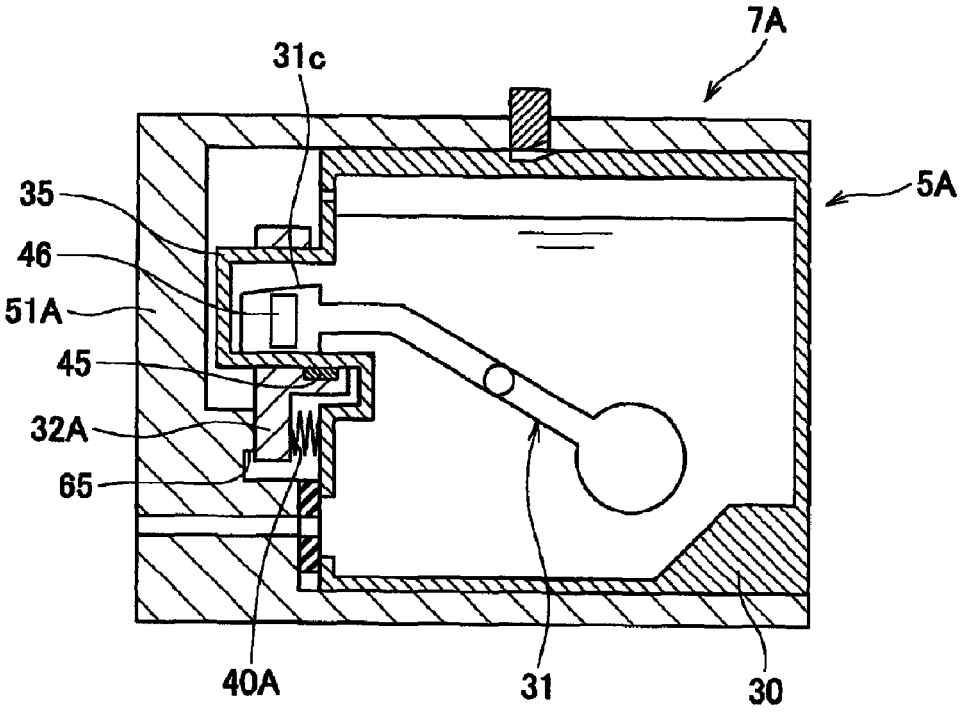
Figure 8:
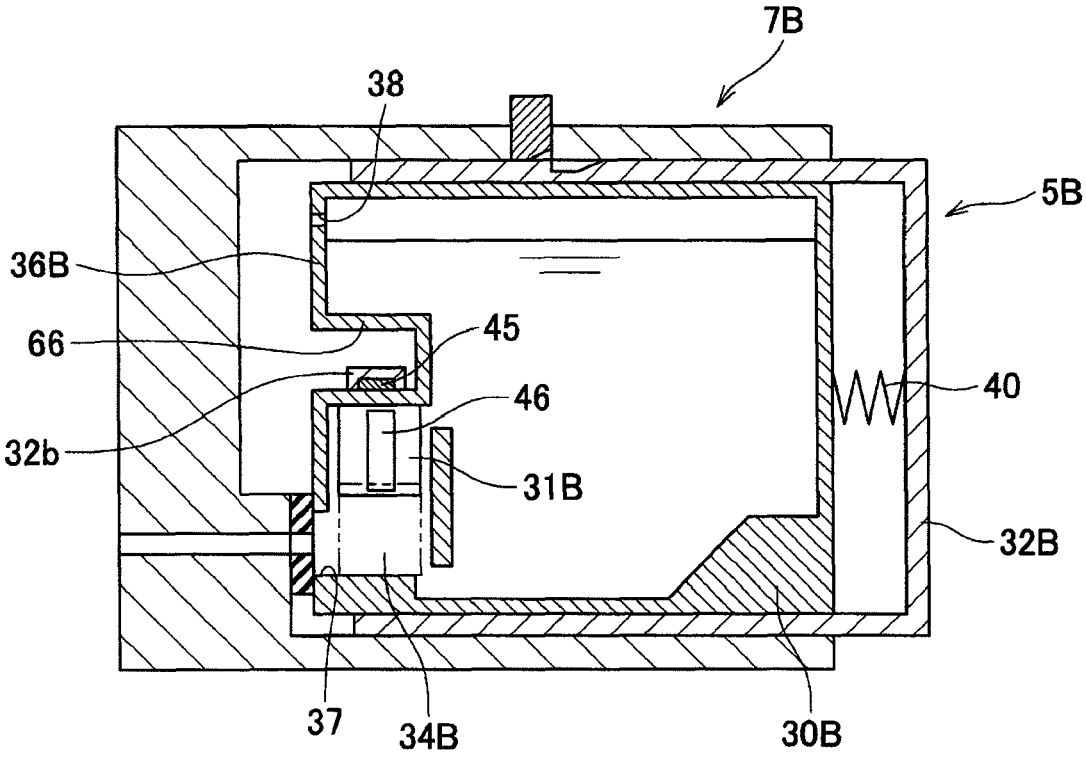
FIG. 8 is cross-sectional view of an ink cartridge and a holder according to still another embodiment of the present invention, in which the ink cartridge is being mounted to a cartridge mounting portion of the holder.

For example, referring to FIGS. 7(A) and 7(B), in another embodiment, an ink cartridge 5A may comprise the case 30, and a movable member 32A positioned at a front portion of the case 30, such that the movable member 32A moves in the mounting direction D and the direction opposite to the mounting direction D. A spring 40A, as an example of the retainer may be interposed between the case 30 and the movable member 32A, and the movable member 32A is retained in a first position as shown in FIG. 7(A) by the spring 40A. The permanent magnet 45 may be supported at a portion of the movable member 32A contacting the lower outer surface of the projecting portion 35. When the movable member 32A is positioned in the first position, the permanent magnet 45 may be positioned directly below the light blocking panel 31*c*. A magnetic force may act between the metal piece 46 of the light blocking panel 31*c* and the permanent magnet 45 of the second movable member 32A, such that the metal piece 46 and the permanent magnet 45 attracts each other.

An contact portion 65 as an example of the release member may be provided at a front wall 51A of a cartridge mounting portion 7A, and the contact portion 65 may be configured to contact the movable member 32A of the ink cartridge 5A and not contact the case 30 when the ink cartridge 5A is mounted to the cartridge mounting portion 7A. Therefore, when the case 30 is further pushed forward from the state where the movable member 32A contacts the contact portion 65 as shown in FIG. 7(A), the case 30 may move relative to the movable member 32A in the mounting direction D because a reactive force acts on the movable member 32A from the contact portion 65 and, consequently, the movable member 32A may move to a second position as shown in FIG. 7(B), which is positioned backward from the first position as shown in FIG. 7(*a*) relative to the case 30. Accordingly, the position of the permanent magnet 45 may be displaced backward from the position directly below the light blocking panel 31*c*, and the light blocking panel 31*c* may be released from the fixed position.

As a first movable member configured to be move according to an amount of ink stored in a case may be a float by itself. For example, referring to FIG. 8, in another embodiment, an ink cartridge 5B may comprise the ink supply opening 37 and the air communication opening 38 formed through a front wall 36B of a case 30B, and a depressed portion 66 may be formed between the ink supply opening 37 and the air communication opening 38, and a sensor chamber 34B may be formed below the depressed portion 66. A light blocking panel 31B formed of the float may be disposed in the sensor chamber 34B so as to be movable in the gravitational direction according to the change of the ink amount. The supporting portion 32*b* of a cover 32B may contact an inner surface of the depressed portion 66, and the permanent magnet 45 which attracts the metal piece 46 of the light-shielding panel 31B may be supported by the supporting portion 32*b*. Therefore, when the ink cartridge 5B is not mounted to a cartridge mounting portion 7B, the light blocking panel 31B formed of the float may be attracted upward by the permanent magnet 45 supported by the supporting portion 32*b*, and may be fixed to the case 30B, contacting the top surface of the sensor chamber 34B, which is positioned below the depressed portion 66.

A movable member configured to move according to an amount of liquid stored in a case may not be limited to a light blocking panel whose position is detected by a optical sensor having a light-emitting portion and a light-receiving portion. For example, in another embodiment, a movable member may be connected to a float positioned in a case storing liquid and may move outside the case in association with the upward and downward movement of the float. In this case, because the position of the movable member moving outside the case can be detected by sensors other than the optical sensor such as a proximity sensor or a limit switch provided at a cartridge mounting portion, the movable member may not have to be configured as a light blocking panel.

A movable member configured to support the magnetic material may not necessarily have to be movable in the mounting direction D relative to a case. A second movable member and a case may be retained at a predetermined positional relationship at which a first movable member can be fixed by the magnetic force acting between the magnetic materials when an ink cartridge is not mounted to a cartridge mounting portion, while the second movable member and the case may move relative to each other in a certain direction other than the mounting direction D when the ink cartridge is mounted to the cartridge mounting portion. For example, in another embodiment, the position of the magnetic material may be changed by rotating the second movable member with respect to the case via a link mechanism or the like which is operated in conjunction with the mounting operation of the ink cartridge.

A retainer configured to retain a second movable member in a first position may not be limited to a spring, and may be a locking mechanism which locks the second movable member at the first position. Furthermore, a release member at the cartridge mounting portion configured to release the second movable member from the locked state may be modified as needed according to the retainer. For example, when the retainer is the locking mechanism described above, the release member may be configured to be suitable for releasing the locked state by the locking mechanism.

Although the first movable member is released from the fixed state by the movement of the second movable member relative to the case in association with the mounting operation of the ink cartridge in the embodiments described above, in another embodiment, a user may release a second movable member from a retained state, such that a first movable member is released from a fixed state before mounting an ink cartridge to a cartridge mounting portion, and then may mount the ink cartridge to the cartridge mounting portion. In this case, a release member for releasing the second movable member may not be provided at the cartridge mounting portion.

Although the embodiments described above are examples in which the present invention is applied to the ink cartridge used in the ink jet printer, the present invention may be applied irrespective of the usage or the type of liquid stored in a liquid cartridge.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid supply apparatus comprising:

a container mounting portion; and a liquid container configured to be removably mounted to the container mounting portion, the liquid container comprising:

a case configured to store liquid therein;

a first movable member positioned in the case and configured to move relative to the case according to an amount of liquid stored in the case;

a second movable member positioned on the case and configured to move relative to the case between a first position and a second position; and a retainer configured to retain the second movable member in the first position, wherein the first movable member and the second movable member comprise a pair of magnetic materials on which a magnetic force acts, such that the pair of magnetic materials attracts each other, when the second movable member is in the first position, the first movable member is in a fixed state in which the first movable member is immovably fixed to the case by the magnetic force acting between the pair of magnetic materials, when the second movable member moves from the first position to the second position, the first movable member is released from the fixed state, and the container mounting portion comprises a release member configured to release the second movable member from a retained state in which the second movable member is retained in the first position by the retainer, such that the second movable member moves from the first position to the second position, when the liquid container is mounted to the container mounting portion.

2. The liquid supply apparatus according to claim 1, wherein the first movable member is configured to move in a first direction when the first movable member is released from the fixed state and the amount of liquid stored in the case is reduced, and when the liquid container is not mounted to the container mounting portion, the first movable member is fixed to the case by the magnetic force acting between the pair of magnetic materials in an end position of a movable range of the first movable member in the first direction.

3. The liquid supply apparatus according to claim 2, further comprising:

a movement detector configured to detect whether or not the first movable member moves in a second direction opposite to the first direction when the liquid container is mounted to the container mounting portion and the first movable member is released from the fixed state; and a determiner configured to determine whether or not a predetermined amount or more of liquid is stored in the case, based on result of detection by the movement detector.

4. The liquid supply apparatus according to claim 1, wherein the second movable member is configured to move relative to the case in a mounting direction along which the liquid container is mounted to the container mounting portion, and the release member is configured to contact either one of the case and the second movable member when the liquid container is mounted to the container mounting portion, such that the second movable member moves relative to the case while the either one of the case and the second member receives a reactive force from the release member.

5. The liquid supply apparatus according to claim 1, wherein the first movable member comprises a float configured to move according to a change of a liquid level in the case when the first movable member is released from the fixed state.

6. The liquid supply apparatus according to claim 1 wherein, the liquid container further comprises a float positioned in the case and configured to move according to a change of a liquid level in the case, and an arm connected at a first end thereof to the float and configured to pivot relative to the case, and the first movable member is connected to a second end of the arm opposite the first end, such that the first movable member moves relative to the case in response to a movement of the float when the first movable member is released from the fixed state.

7. A liquid container comprising:

a case configured to store liquid;

a first movable member positioned in the case and configured to move relative to the case according to an amount of liquid stored in the case;

a second movable member positioned on the case and configured to move relative to the case between a first position and a second position; and a retainer configured to retain the second movable member in the first position, wherein the first movable member and the second movable member comprise a pair of magnetic materials on which a magnetic force acts such that the pair of magnetic materials attracts each other, when the second movable member is in the first position, the first movable member is in a fixed state in which the first movable member is immovably fixed to the case by the magnetic force acting between the pair of magnetic materials, when the second movable member is released from a retained state in which the second movable member is retained in the first position by the retainer, such that the second movable member moves from the first position to the second position, the first movable member is released from the fixed state.

8. The liquid container according to claim 7, wherein the first movable member is configured to move in a first direction when the first movable member is released from the fixed state and the amount of liquid stored in the case is reduced, and the first movable member is fixed to the case by the magnetic force acting between the pair of magnetic materials in an end position of a movable range of the first movable member in the first direction.

* * * * *